US008717090B2

(12) United States Patent
Marinca et al.

(10) Patent No.: US 8,717,090 B2
(45) Date of Patent: May 6, 2014

(54) PRECISION CMOS VOLTAGE REFERENCE

(75) Inventors: Stefan Marinca, Limerick City (IE); Denis M. O'Connor, Banteer (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 13/556,778

(22) Filed: Jul. 24, 2012

(65) Prior Publication Data

US 2014/0028376 A1 Jan. 30, 2014

(51) Int. Cl.
*G05F 1/10* (2006.01)
*G05F 3/02* (2006.01)

(52) U.S. Cl.
USPC ..... 327/539; 327/513

(58) Field of Classification Search
USPC ..... 327/513, 539; 323/313, 315, 316
See application file for complete search history.

(56) References Cited

U.S. PATENT DOCUMENTS

| | | | | |
|---|---|---|---|---|
| 7,576,598 | B2 * | 8/2009 | Marinca | 327/539 |
| 2009/0243711 | A1 * | 10/2009 | Marinca | 327/541 |
| 2009/0243713 | A1 * | 10/2009 | Marinca | 327/542 |
| 2010/0001711 | A1 * | 1/2010 | Marinca | 323/313 |
| 2010/0127763 | A1 * | 5/2010 | Marinca | 327/539 |

* cited by examiner

*Primary Examiner* — Quan Tra
(74) *Attorney, Agent, or Firm* — Kenyon & Kenyon, LLP

(57) ABSTRACT

A system provides for a voltage reference having a small temperature coefficient spread. The voltage reference includes a PTAT voltage trimming circuit that accurately trims the CTAT voltage component of the bandgap type voltage reference. The voltage trimming circuit includes two bipolar transistors that are biased by biasing currents to create a specific base-emitter voltage difference at an output. The bias currents can be digitally trimmed by a current digital-to-analog ("DAC") converter. This may result in the ability to trim the voltage reference at a single temperature, without the need to trim at two or more temperatures.

21 Claims, 5 Drawing Sheets

PRECISION CMOS VOLTAGE REFERENCE

FIELD OF THE INVENTION

The present invention relates to voltage reference circuits. The present invention further relates to a system and method to provide a voltage independent of any process dependency.

BACKGROUND INFORMATION

A bandgap type voltage reference is based on summation of two voltage components having opposite temperature variations. A first component is a base-emitter voltage of a bipolar transistor. This voltage decreases as temperature increases, and therefore may be referred to as a complementary to absolute temperature ("CTAT") voltage. If a base-emitter voltage is extrapolated back from room temperature close to absolute zero this voltage approaches a constant, referred to as the extrapolated bandgap voltage, denoted Eg0, of the order of 1.15 V to 1.2 V. As temperature increases the base-emitter voltage decreases, and at room temperature the base-emitter voltage is of the order of 600 mV to 700 mV, depending on silicon parameters and bias current. This temperature variation is usually compensated for by using a second voltage component, which is referred to as a proportional to absolute temperature, ("PTAT"). This second voltage component corresponds to a base-emitter voltage difference of two bipolar transistors operating at two different collector current densities.

When the two voltage components, CTAT and PTAT, are well balanced, a compound voltage based on summation still has a second order temperature nonlinearity, referred to as curvature. When this second order error is compensated for, the resulting voltage is said to be temperature insensitive, acting as a voltage reference to Eg0. This creates the undesirable effect for the bandgap type voltage reference that Eg0 is process dependent, differing slightly from process to process, lot to lot, and die to die.

FIG. 1 illustrates a typical process independent voltage reference according to previous configurations. The main objective of this architecture is to be independent of any process variation. In order to achieve this, a target voltage is set that differs from Eg0. This target voltage can represent a base-emitter voltage at a given temperature, such as around ambient. This voltage is sensitive to process and bias conditions, but can be measured and adjusted to a given value.

The configuration in FIG. 1 includes an integrated circuit including a bipolar transistor Q1, here assumed to be a substrate bipolar transistor, biased with a current I1 from a current source. The integrated circuit also includes an amplifier A1, two switches S1 and S2, a second bias current I2 from a second current source, and a feedback resistor, Rf. In a normal operating mode S1 is closed and S2 is open. As a result, the output voltage, the voltage at the amplifier's output node, consists of three added voltage components: a base-emitter voltage of Q1, an amplifier offset voltage, and a voltage drop across Rf due to the bias current I2. The configuration in FIG. 1 assumes that the second order errors such as "curvature" are zero and the voltages are linearly related to absolute temperature.

The voltage reference in the configuration in FIG. 1 is trimmed at two temperatures such that the two trimmings do not interfere with each other. This can be accomplished by forcing bias current I2 to zero at a first temperature, T1, which means that it has a temperature dependency such that it is extracted from the amplifier A1's inverting node for temperatures below T1, and is injected to the inverting node for temperatures higher than T1. Bias current I2 corresponds to a difference of two currents, one current corresponding to the PTAT and one current corresponding to CTAT. At a temperature where T=T1, S1 can be opened and S2 is closed with the bias current I2 forced to zero. In this situation, the output voltage results in the base-emitter voltage of Q1 plus an offset voltage of the amplifier. This output voltage however, is process dependent. In order to compensate for process variation at this first temperature, the bias current I1 is trimmed in such a manner that the output voltage always remains the same. At a second temperature, T2, S1 is closed and S2 is open. At this second temperature, the feedback resistor Rf is trimmed to force the output voltage to the same voltage that was present after the initial trimming step. As a result, the output voltage maintains the same value at the two temperatures, T1 and T2, and is temperature independent. A significant drawback of the configuration of the voltage reference configuration of FIG. 1, however, is the excessively large trimming range of the bias current I2 that is required to cover all process variations.

Thus there remains a need in the art, for a voltage reference circuit that has an improved bandgap voltage without a large trimming range. There further remains a need in the art for an improved temperature coefficient spread for only a single temperature trim.

SUMMARY OF THE INVENTION

A system and method are described herein that provide for a voltage reference circuit architecture having a small temperature coefficient spread. The voltage reference includes a PTAT voltage trimming circuit that accurately trims the bandgap type voltage to a specific value so that the PTAT voltage and the CTAT voltage are consistent. The voltage trimming circuit includes two bipolar transistors that are biased by biasing currents to create a specific base-emitter voltage difference at an output. The bias currents can be digitally trimmed by a current digital-to-analog ("DAC") converter. This may result in the ability to trim the voltage reference at a single temperature, without the need to trim at two or more temperatures.

In particular, the exemplary embodiments and/or exemplary methods of the present invention are directed to a precision voltage reference circuit to improve a temperature coefficient spectrum. The voltage reference circuit includes a first amplifier, where a complementary to absolute temperature ("CTAT") voltage is generated at a non-inverting input to the first amplifier and a proportional to absolute temperature ("PTAT") voltage is generated at the inverting input to the first amplifier. The voltage reference circuit also includes a plurality of diodes coupled to the inputs of the first amplifier, with each of the diodes biased with a respective bias current. The diodes can be normal transistors or substrate bipolar transistors.

The voltage reference circuit also includes a plurality of resistors, with a select few of the resistors being variable resistors and the rest of the resistors being fixed. The resistors can also be used to adjust the respective bias currents of the diodes. Values of the resistors can be determined in order to provide a correction for curvature error.

The voltage reference circuit also includes a second amplifier coupled to the first amplifier and a PTAT voltage correction circuit to trim the PTAT voltage. The voltage reference circuit can be configured to trim the PTAT voltage at a single temperature, with the PTAT voltage being consistent with the CTAT voltage. In this case, the PTAT voltage and CTAT voltage are independent of any process variations.

The voltage reference circuit also includes a first digital-to-analog converter ("DAC") coupled to the output of the first amplifier and to a non-inverting input of the second amplifier, and a second digital-to-analog converter ("DAC") coupled to the output of the second amplifier.

The PTAT correction circuit in the reference voltage can include a plurality of bipolar transistors biased with a high collector current density and a plurality of bipolar transistors biased with a low collector current density. The PTAT voltage correction circuit can generate a base-emitter voltage difference between the high collector current density bipolar transistors and the low collector current density bipolar transistors, using for example, a closed loop amplifier. The bias currents of the high collector current density bipolar transistors and the low collector current density bipolar transistors can be switchably trimmed by a digital input of a current digital-to-analog converter ("DAC").

The exemplary embodiments and/or exemplary methods of the present invention are also directed a method for improving a temperature coefficient spectrum of a voltage reference. This method includes the step of determining a value for a first variable resistor in the voltage reference based on a characterization to correct curvature error of the voltage reference. At a first temperature, a second variable resistor in the voltage reference is trimmed until a voltage drop across a connected fixed resistor in the voltage reference is zero. This may correspond to the trimming of a proportional to absolute temperature ("PTAT") voltage. Also at the first temperature, an output of the voltage reference can be adjusted by a first digital-to-analog converter ("DAC").

At a second temperature, the temperature coefficient can be corrected by a second digital-to-analog converter ("DAC") to fix the output of the voltage reference at a specific voltage. The voltage at the output of the reference voltage is therefore temperature insensitive and independent of any process variations.

DETAILED DESCRIPTION

The subject invention will now be described in detail for specific preferred embodiments of the invention, it being understood that these embodiments are intended only as illustrative examples and the invention is not to be limited thereto.

The present disclosure proposes a precision CMOS voltage reference having a small temperature coefficient spread. The CMOS voltage reference includes a PTAT voltage trimming circuit that accurately trims the bandgap type voltage to a specific value so that the PTAT voltage and the CTAT voltage are process independent. The voltage trimming circuit includes two bipolar transistors that are biased by biasing currents to create a specific base-emitter voltage difference at an output. The bias currents can be digitally trimmed by a current digital-to-analog ("DAC") converter. This may result in the ability to trim the voltage reference at a single temperature, without the need to trim at two or more temperatures.

Figure 1:
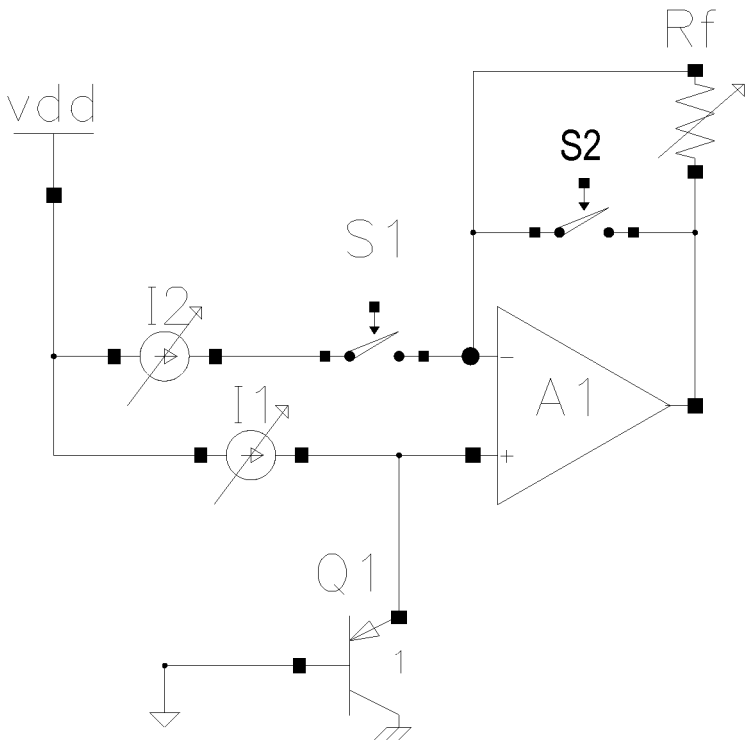
FIG. 1 is a diagram of a process independent voltage reference according to a previous configuration.
Figure 2:
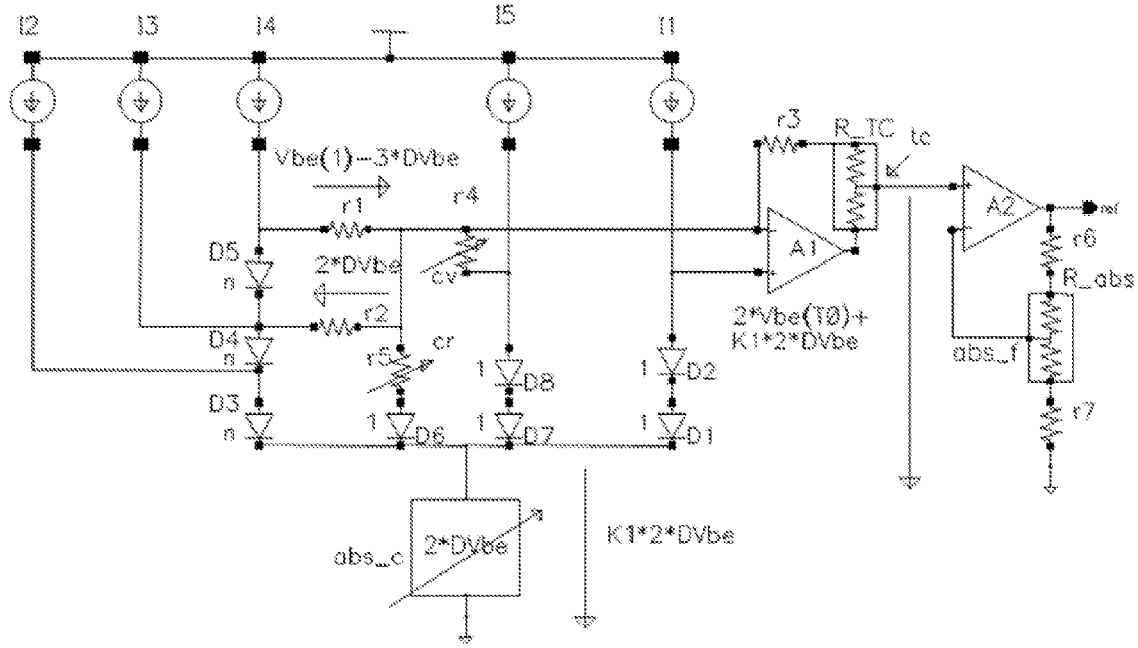
FIG. 2 is a diagram of a schematic of the architecture for a precision voltage reference according to an embodiment of the present invention.

FIG. 2 illustrates a diagram of a schematic of the architecture for a precision voltage reference circuit according to an embodiment of the present invention. In an embodiment, the precision voltage reference circuit may be a CMOS voltage reference. The precision voltage reference integrated circuit embodied in FIG. 2 may include amplifiers, A1 and A2, which are selectively coupled. The precision voltage reference circuit may also include eight diodes, D1 to D8, which may be connected respectively to the inverting and non-inverting inputs of amplifier A1. In an embodiment, diodes D1 to D8 may be normal transistors. In an alternative embodiment, diodes D1 to D8 may be substrate bipolar transistors. In this embodiment, each individual transistor has to be biased individually with a corresponding bias current. In FIG. 2, this may be done by current sources I1 to I5. Current source I1 may bias diodes D1 and D2, where the output of current source I1 may be connected to the non-inverting input of A1. Current source I2 may bias D3, where the bias current may be injected directly to the output of D3 and to the input of D4. Current source I4 may bias D5, where the bias current may be injected directly to the output of D5 and to the input of D4. Current source I4 may bias D5, where the bias current is injected directly to the input of D5. Current source I5 may bias D7 and D8, where the bias current is injected directly to the input of D8 and diodes D7 and D8 are coupled.

The precision voltage reference may also include five fixed resistors, r1, r2, r3, r6, and r7, and two variable resistors, r4 and r5. These resistors may be designed and/or adjusted to adjust the bias current to the diodes and to configure the amplifier stage. The precision voltage reference may also include two string DACs, R_TC and R_abs, and a correcting PTAT voltage circuit, abs_c. In an embodiment, the string DAC R_TC may be configured in a feedback loop for amplifier A1 and may be connected to the non-inverting input of amplifier A2. In another embodiment, the string DAC R_abs may be connected at the output of amplifier A2, which may correspond to a load at the reference output. The PTAT voltage correction circuit, abs_c, may be configured to produce a corrected voltage.

In the embodiment illustrated in FIG. 2, the CTAT voltage may be produced at the non-inverting node of the amplifier A1. The CTAT voltage of the precision voltage reference may correspond to 2 times a base-emitter voltage of the diode, which may represent the voltage drops across the diodes D1 and D2. In addition, the CTAT voltage may include a correction voltage generated at the output node of the circuit abs_c. The output voltage of the PTAT voltage correction circuit abs_c may be connected to the common node of the diodes D1, D3, D6, D7.

The current injected to the inverting node of A1 is a combination of four currents, from four resistors, r1, r2, r4, and r5. The current through r1 may represent a difference of the CTAT current and the PTAT current, whereas the current across r2 may simply represent the PTAT current. The current across r5 may represent an adjusted CTAT current that force the feedback current to zero at a first temperature, T1, and the current across r4 may represent an adjusted curvature correction current.

During operation, the trimming procedure of the precision voltage reference circuit may be performed in a sequence of steps. The value of resistor r4 may be determined, through various characterizations, which gives the best correction for curvature error. At a first temperature, T1, resistor r5 may be trimmed until the voltage drop across resistor r3 is equal to zero. At the same temperature, T1, the desired voltage reference provided at the output of the amplifier A2, may be adjusted via the gain DAC, R_abs. At a second temperature, T2, the temperature coefficient may be corrected by the DAC R_TC, such that the output voltage may remain at the desired voltage reference. After the last trimming step, the voltage at the output node of A2 may remain temperature insensitive and its value may correspond to the desired value independent of any process variation or amplifier voltage offsets.

Figure 3:
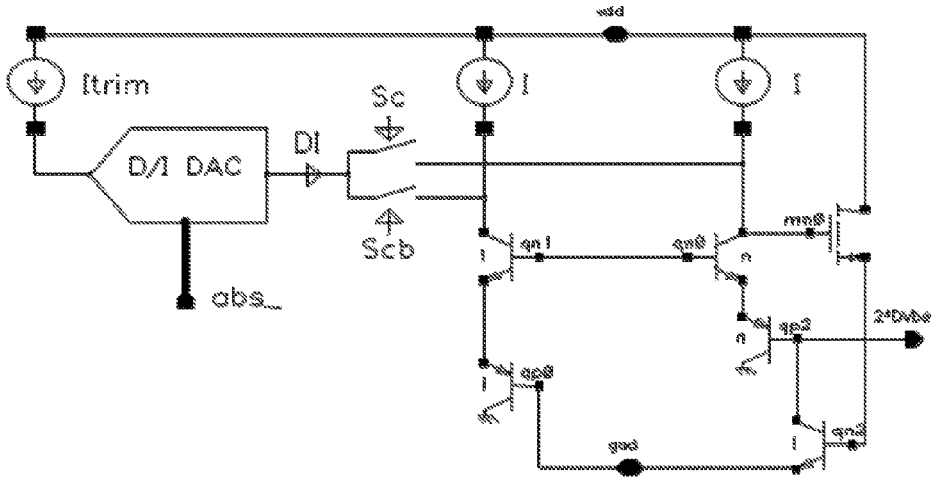
FIG. 3 is a diagram of a PTAT voltage trimming circuit according to an embodiment of the present invention.

FIG. 3 illustrates a diagram of the PTAT voltage trimming circuit, abs_c, according to an embodiment of the present invention. It should be understood that this voltage may be implemented in different ways, including as a PTAT voltage drop across a resistor, and the embodiment in FIG. 3 only illustrates a singular implementation.

PTAT voltage trimming circuit abs_c may include two bipolar transistors, gn1 and qp0. These bipolar transistors may be biased with a high collector current density, since the bipolar transistors may have a unity emitter area. PTAT voltage trimming circuit abs_c may also include two bipolar transistors, qn0 and qp2, that may be biased with a low collector current density, since transistors qn0 and qp2 may be an emitter area equal to n times unity. In an embodiment, the bias currents from the two current sources may have the same value, I. The resulting base-emitter voltage stack difference from gn1, qp0, qn0, and qp2, may be generated at the collector node of qn2. This base-emitter voltage difference may be generated actively via a closed loop amplifier as depicted in FIG. 3. In the example embodiment in FIG. 3, this closed loop amplifier may consist of a connected MOSFET device and bipolar transistor, mn0 and qn2. The bias currents for the bipolar transistor qn0, gn1, qp0, and qp2 may be trimmed via a current DAC. The trimming DAC current may itself be biased with a fixed current, Itrim, having the same temperature dependency as the main currents, I. The output current of the trimming DAC may be forced, via two switches, Sc and Scb, through the high current density arm of the PTAT voltage trimming circuit or through the low current density arm of the PTAT voltage trimming circuit. When the trimming bias current is injected into the high current density arm of the PTAT voltage trimming circuit abs_c, the output voltage may be represented by Equation (1):

$$\Delta V_{be} = 2 * \frac{KT}{q} * \ln\left[n\left(\frac{I + DI}{I}\right)\right]. \tag{1}$$

When the trimming bias current is injected into the low current density arm of the circuit the output voltage may be represented by Equation (2):

$$\Delta V_{be} = 2 * \frac{KT}{q} * \ln\left[n\left(\frac{I}{I + DI}\right)\right]. \tag{2}$$

As a result, in one embodiment, the output voltage of the PTAT voltage trimming circuit may go high and may be digitally trimmed via the digital input code to the current DAC. In a second embodiment, the corresponding output voltage may go low and its variation may be digitally controlled via the same input code. The two switches, Sc and Scb, may therefore be viewed as sign switches.

Figure 4:
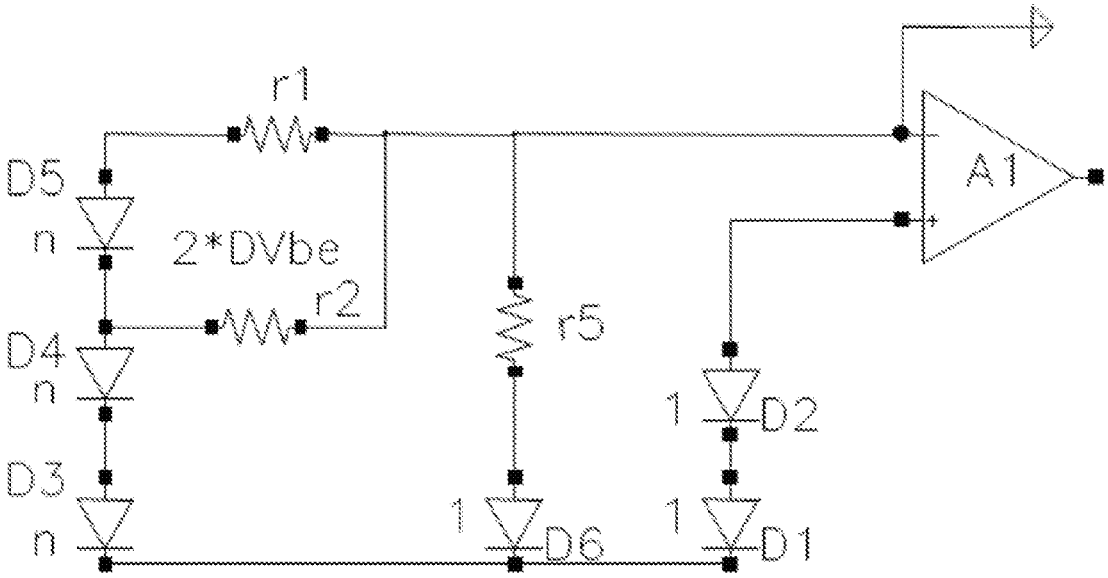
FIG. 4 is a diagram of the architecture for the feedback current for the precision voltage reference without a curvature correction component according to an embodiment of the present invention.

FIG. 4 illustrates how the feedback current of amplifier A1 is generated, without a curvature correction component, according to an embodiment of the invention. A voltage drop across resistor r1 may correspond to a voltage difference between the sum of the three base-emitter voltages of low current density bipolar transistors (D3, D4, D5) and the sum of the two base-emitter voltages of high current density bipolar transistors (D1, D2). The current through resistor r1 and to the inverting input of amplifier A1 may be represented by Equation (3) and the voltage difference across r1 may be represented by Equation (4):

$$I_{r1} = \frac{3 * V_{be}(n) - 2 * V_{be}(1)}{r1} = \frac{V_{be}(1) - 3 * \Delta V_{be}}{r1}, \tag{3}$$

$$\Delta V_{be} = \frac{KT}{q} * \ln n. \tag{4}$$

The voltage drop across resistor r2 may correspond to a voltage difference between two base-emitter voltages of high current density bipolar transistors (D1, D2) and two base-emitter voltages of low current density bipolar transistors (D3, D4). This voltage drop may be represented by Equation (5):

$$I_{r2} - \frac{2 * \Delta V_{be}}{r2}. \tag{5}$$

The purpose of r5 resistor may be to set zero feedback current at a first temperature, T1. The corresponding current is through resistor r5 may therefore be represented by Equation (6):

$$I_{r5} = \frac{V_{be}(1)}{r5}. \tag{6}$$

In the precision voltage reference as illustrated in FIG. 2, the role of resistor r4 of the integrating circuit may be to correct for the second order error term for the curvature of the base-emitter voltages of the respective diodes. Equation (7) may depict the base-emitter voltage temperature dependency of a bipolar transistor:

$$V_{be}(T) = V_{G0} - (V_{G0} - V_{be0}) * \frac{T}{T_0} - \sigma * \frac{KT_0}{q} * \frac{T}{T_0} * \ln\left(\frac{T}{T_0}\right) + \frac{KT_0}{q} * \frac{T}{T_0} * \ln\left(\frac{Ic(T)}{Tc(T0)}\right), \tag{7}$$

where $V_{G0}$ represents the extrapolated bandgap voltage, $V_{be0}$ represents the base-emitter voltage at temperature $T_0$, T represents the current temperature, σ represents the saturation current temperature exponent, Ic(T) represents the collector current at temperature T, and Ic(T0) represents the collector current at temperature T0.

The diodes D1 and D2 (or corresponding bipolar transistors) of the precision voltage reference circuit may be biased with PTAT currents such that the compound base-emitter voltage of the two diodes may be represented by Equation (8):

$$2*V_{be}(T) = 2*\left[V_{G0}-(V_{G0}-V_{be0})*\frac{T}{T_0}-(\sigma-1)*\frac{KT_0}{q}*\frac{T}{T_0}*\ln\left(\frac{T}{T_0}\right)\right]. \quad (8)$$

The diodes D7 and D8 may be biased with constant currents such that the compound base-emitter of the two diodes may be represented by Equation (9):

$$2*V_{be}(T) = 2*\left[V_{G0}-(V_{G0}-V_{be0})*\frac{T}{T_0}-\sigma*\frac{KT_0}{q}*\frac{T}{T_0}*\ln\left(\frac{T}{T_0}\right)\right]. \quad (9)$$

The voltage drop across resistor r4 may therefore be represented by Equation (10):

$$V_{r4} = 2*\frac{\frac{KT_0}{q}*\frac{T}{T_0}*\ln\left(\frac{T}{T_0}\right)}{r4}. \quad (10)$$

In an embodiment, the curvature errors of the base-emitter voltages in the precision voltage reference circuit may be compensated for by properly scaling resistors r2 and r3 to a specified ratio.

Figure 5:
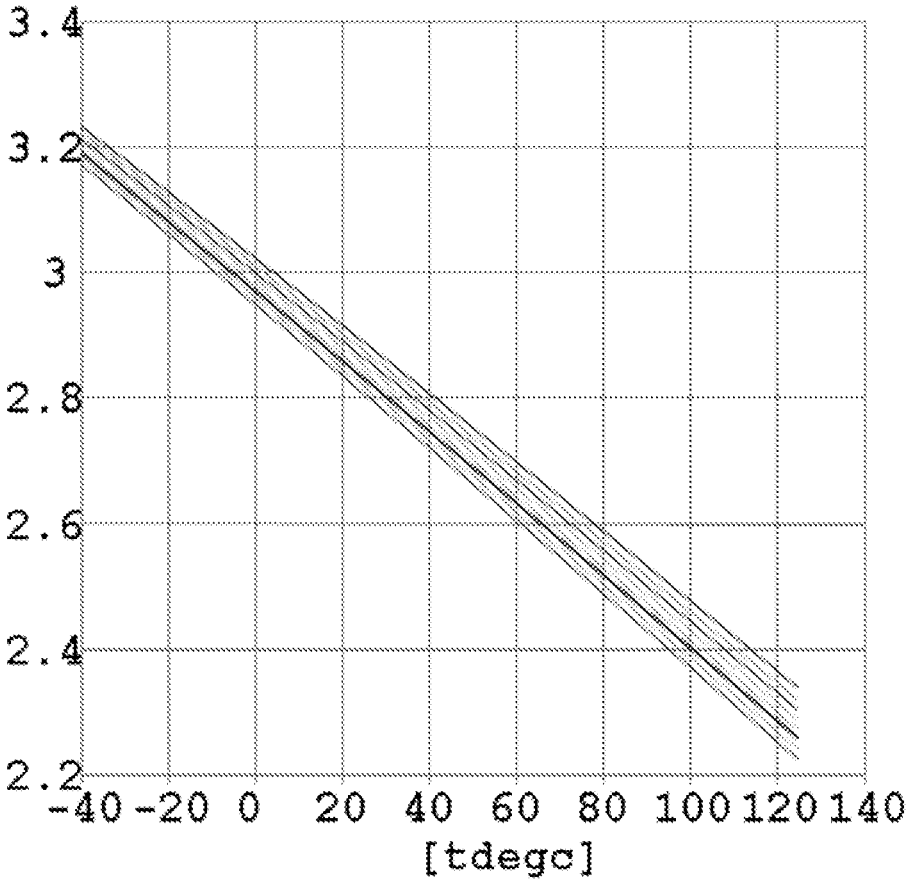
FIG. 5 is a diagram representing the untrimmed CTAT voltage component of the voltage reference.

FIG. 5 is a diagram illustrating the untrimmed CTAT voltage component of the precision voltage reference illustrated in FIG. 2. As can be seen, the CTAT voltage component of the reference voltage at a given temperature has a large spread. This spread may be mainly due to the base emitter voltage process variation.

Figure 6:
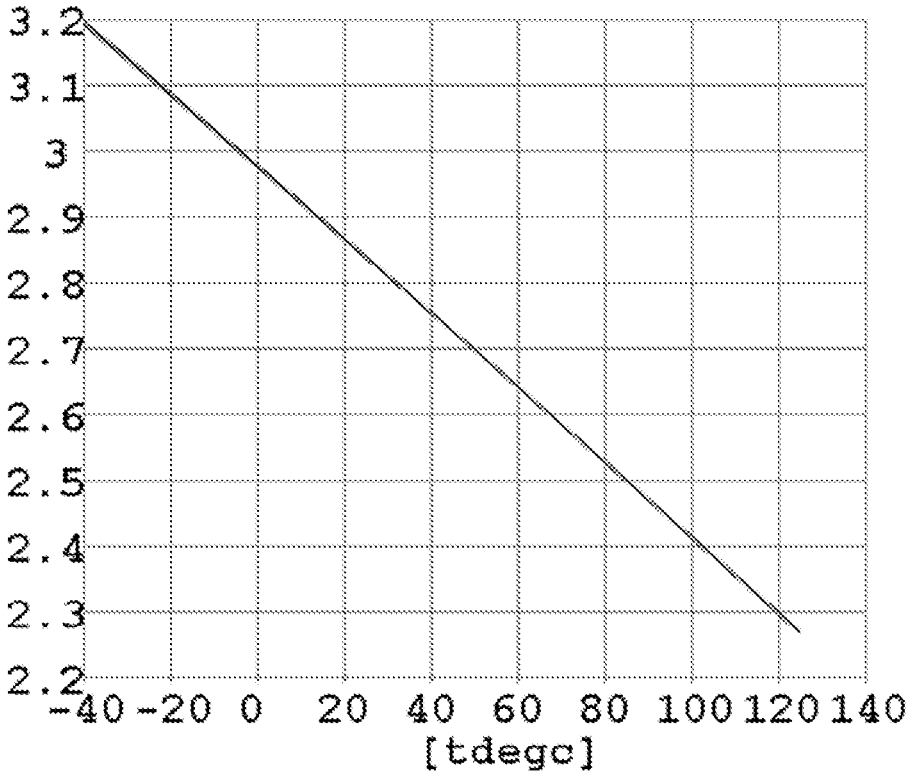
FIG. 6 is a diagram of the trimmed CTAT voltage according to the present invention.

FIG. 6 is a diagram of the same CTAT voltage after trimming according to the present invention. According to FIG. 2, this voltage may consist of a stack of three voltage components: two base emitter voltages and a trimmable PTAT voltage. At a given temperature the trimmable PTAT voltage may be adjusted to get the compound voltage value to always be equal to a predetermined target value.

A significant advantage of the precision voltage reference circuit over the previous configuration may be rooted in the limited trimming range required for absolute value and temperature coefficient trimming. This occurs because after the first two trimming steps the compound voltage reference (PTAT plus CTAT) may be completely compensated for in process variations. This may result in the ability to trim the reference at a single temperature, T1. As a result the voltage reference circuit may be cost effective and result in high yields and high precision.

Several embodiments of the invention are specifically illustrated and/or described herein.

However, it will be appreciated that modifications and variations of the invention are covered by the above teachings and within the purview of the appended claims without departing from the spirit and intended scope of the invention.

What is claimed is:

1. A precision voltage reference circuit to improve a temperature coefficient spectrum, the circuit comprising:

an amplifier, wherein a complementary to absolute temperature ("CTAT") voltage is generated at a non-inverting input to the amplifier and a proportional to absolute temperature ("PTAT") voltage is generated at an inverting input to the amplifier;

a plurality of resistors, the resistors adjusting different components of a trimmed voltage reference; and a PTAT voltage correction circuit to trim the CTAT voltage;

wherein the PTAT voltage is trimmed at a single temperature to be consistent with the CTAT voltage, the PTAT voltage and CTAT voltage being independent of process variations.

2. The circuit according to claim 1, further comprising:

a first digital-to-analog converter ("DAC") coupled to an output of the amplifier.

3. The circuit according to claim 1, wherein values of the resistors are determined in order to provide a correction for curvature error.

4. The circuit according to claim 1, further comprising:

a plurality of diodes coupled to the inputs of the amplifier, each of the diodes biased with a respective bias current, wherein the diodes are substrate bipolar transistors.

5. The circuit according to claim 1, wherein the PTAT correction circuit includes a plurality of bipolar transistors biased with a high collector current density and a plurality of bipolar transistors biased with a low collector current density.

6. The circuit according to claim 2, further comprising:

a second amplifier coupled to the amplifier, wherein an output of the first DAC is coupled to a non-inverting input of the second amplifier.

7. The circuit according to claim 6, further comprising:

a second digital-to-analog converter ("DAC") coupled to an output of the second amplifier and having an output connected to an inverting input of the second amplifier.

8. The circuit according to claim 5, wherein the PTAT voltage correction circuit generates a base-emitter voltage difference between the high collector current density bipolar transistors and the low collector current density bipolar transistors with a closed loop amplifier.

9. The circuit according to claim 5, wherein bias currents of the high collector current density bipolar transistors and the low collector current density bipolar transistors are switchably trimmed by a digital input of a current digital-to-analog converter ("DAC").

10. A proportional to absolute temperature ("PTAT") voltage correction circuit, the circuit comprising:

a plurality of bipolar transistors biased with a high collector current density;

a plurality of bipolar transistors biased with a low collector current density coupled to the high collector current density bipolar transistors;

a closed loop amplifier generating a base-emitter voltage difference between the high collector current density bipolar transistors and the low collector current density bipolar transistors; and a current digital-to-analog converter ("DAC") switchably controlled to alternately trim bias currents of the high collector current density bipolar transistors and the low collector current density bipolar transistors.

11. A method for improving a temperature coefficient spectrum of a voltage reference, the method comprising:

determining a value for a first variable resistor in the voltage reference based on a characterization to correct curvature error of the voltage reference;

at a first temperature, trimming a second variable resistor in the voltage reference until a voltage drop across a connected fixed resistor in the voltage reference is zero;

adjusting an output of the voltage reference at the first temperature by a first digital-to-analog converter ("DAC"); and at a second temperature, correcting the temperature coefficient by a second digital-to-analog converter ("DAC") to fix the output of the voltage reference at a specific voltage;

wherein the specific voltage at the output of the reference voltage is temperature insensitive and independent of process variations.

12. The method according to claim 11, wherein a proportional to absolute temperature ("PTAT") voltage is trimmed at the first temperature.

13. The method according to claim 11, further comprising: biasing a plurality of diodes in the voltage reference.

14. The method according claim 11, wherein the trimming is performing by a proportional to absolute temperature ("PTAT") correction circuit.

15. The method according to claim 12, wherein the trimmable PTAT voltage is adjusted to compensate for base emitter voltages process variation resulting in a process independent of a compound complementary to absolute temperature ("CTAT") voltage.

16. The method according to claim 13, wherein the diodes are substrate bipolar transistors.

17. The method according to claim 14, wherein the PTAT correction circuit includes a plurality of bipolar transistors biased with a high collector current density and a plurality of bipolar transistors biased with a low collector current density.

18. The method according to claim 17, wherein the PTAT voltage correction circuit generates a base-emitter voltage difference between the high collector current density bipolar transistors and the low collector current density bipolar transistors with a closed loop amplifier.

19. The method according to claim 17, wherein bias currents of the high collector current density bipolar transistors and the low collector current density bipolar transistors are switchably trimmed by a digital input of a current digital-to-analog converter ("DAC").

20. The circuit according to claim 10, wherein the closed loop amplifier includes a metal-oxide-semiconductor field-effect transistor ("MOSFET") device connected to a bipolar transistor.

21. The circuit according to claim 4, wherein the plurality of resistors is coupled to the inverting input of the amplifier, and the PTAT voltage correction circuit is coupled to at least one of the plurality of diodes.

* * * * *